US009169684B2

(12) United States Patent
Fan et al.

(10) Patent No.: US 9,169,684 B2
(45) Date of Patent: Oct. 27, 2015

(54) METHODS, PROGRAM PRODUCTS, AND SYSTEMS RELATING TO VEHICULAR GARAGE DOOR CONTROL SYSTEMS

(71) Applicant: GM GLOBAL TECHNOLOGY OPERATIONS LLC, Detroit, MI (US)

(72) Inventors: Yue Fan, Ann Arbor, MI (US); John C. Lyons, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 274 days.

(21) Appl. No.: 13/871,290

(22) Filed: Apr. 26, 2013

(65) Prior Publication Data

US 2014/0320263 A1 Oct. 30, 2014

(51) Int. Cl.

| | |
|---|---|
| ***E05F 15/00*** | (2015.01) |
| ***E05F 15/20*** | (2006.01) |
| ***E05F 15/77*** | (2015.01) |

(52) U.S. Cl.

CPC ..... *E05F 15/2076* (2013.01); *E05F 15/77* (2013.01); *E05Y 2400/54* (2013.01); *E05Y 2400/66* (2013.01); *E05Y 2900/106* (2013.01)

(58) Field of Classification Search

CPC .... E05F 5/77; E05F 2015/767; E05F 15/2076
USPC ..... 340/5.71
See application file for complete search history.

(56) References Cited

U.S. PATENT DOCUMENTS

| | | | | |
|---|---|---|---|---|
| 4,961,212 | A | 10/1990 | Marui et al. | |
| 5,353,376 | A | 10/1994 | Oh et al. | |
| 5,864,603 | A | 1/1999 | Haavisto et al. | |
| 6,041,300 | A | 3/2000 | Ittycheriah et al. | |
| 6,131,044 | A | 10/2000 | Ryu | |
| 6,167,251 | A | 12/2000 | Segal et al. | |
| 6,212,408 | B1 | 4/2001 | Son et al. | |
| 6,240,303 | B1 | 5/2001 | Katzur | |
| 6,366,649 | B1 | 4/2002 | Chun et al. | |
| 6,377,173 | B1 | 4/2002 | Desai | |
| 6,389,337 | B1 * | 5/2002 | Kolls | 701/31.6 |
| 6,449,496 | B1 | 9/2002 | Beith et al. | |
| 6,505,159 | B1 | 1/2003 | Theodore | |
| 6,525,645 | B2 * | 2/2003 | King et al. | 340/5.7 |
| 7,135,957 | B2 | 11/2006 | Wilson | |
| 7,167,076 | B2 | 1/2007 | Wilson | |
| 7,349,722 | B2 | 3/2008 | Witkowski et al. | |
| 7,778,604 | B2 | 8/2010 | Bauman et al. | |
| 2001/0000505 | A1 | 4/2001 | Segal et al. | |
| 2002/0146999 | A1 | 10/2002 | Witte | |
| 2003/0032460 | A1 | 2/2003 | Cannon et al. | |
| 2004/0135670 | A1 * | 7/2004 | Guba | 340/5.21 |
| 2007/0167138 | A1 * | 7/2007 | Bauman et al. | 455/41.2 |
| 2008/0291047 | A1 * | 11/2008 | Summerford et al. | 340/825.69 |
| 2014/0118111 | A1 * | 5/2014 | Saladin et al. | 340/7.51 |

* cited by examiner

*Primary Examiner* — Edwin Holloway, III
(74) *Attorney, Agent, or Firm* — Ingrassia Fisher & Lorenz, P.C.

(57) ABSTRACT

Embodiments of method performed in conjunction with a vehicular garage door control system are provided, as are embodiments of a vehicular garage door control system and a program product executed by a smartphone in communicating with such a garage door control system. The vehicular garage door control system may include an in-vehicle Garage Door Opener (GDO) signal generator, a wireless receiver, and a controller. In one embodiment, the method includes receiving, at the controller via the wireless receiver, a request signal originating from a remote electronic device requesting actuation of a GDO unit that, when actuated, moves a garage door between open and closed positions. In response to receipt of the request signal, a command signal is supplied from the controller to the in-vehicle GDO signal generator commanding the in-vehicle GDO signal generator to generate a GDO actuation signal requesting actuation of the GDO unit.

16 Claims, 4 Drawing Sheets

METHODS, PROGRAM PRODUCTS, AND SYSTEMS RELATING TO VEHICULAR GARAGE DOOR CONTROL SYSTEMS

TECHNICAL FIELD

The present invention relates generally to motor vehicles, and more particularly, to embodiments of a vehicular garage door control system that can be remotely controlled utilizing a smartphone, a keyfob, or other electronic device, as well as to associated methods and program products.

BACKGROUND

The ability to remotely actuate a Garage Door Opener (GDO) unit from the exterior of a closed garage door is typically provided by a dedicated GDO remote control, and in certain cases, by a keypad mounted near the exterior of the garage door. When an external keypad is not provided for garage door access, a user is typically required to carry the dedicated GDO remote control to retain the ability to reenter through the garage after departing his or her home and closing the garage door. This can be inconvenient in instances wherein the user is required to carry the dedicated GDO remote control on his or her person, as may be the case when the user leaves his or her home for the purposes of walking, biking, running, or the like. Furthermore, even when an external keypad is provided for garage door access, neither the external keypad nor the dedicated GDO remote control permits control of the GDO unit from significant distances as may be desirable when, for example, a user is at work, on vacation, or otherwise physically absent from the home and wishes to remotely open the garage door to grant temporary access to a neighbor, delivery driver, or other person. While the HomeLink® wireless control system and other in-vehicle GDO systems have been developed and are now widely adopted, such systems also do not improve user convenience in the above-noted respects.

It would thus be desirable to provide means for enabling the remote control of a GDO unit without the usage of a dedicated GDO remote control or an externally-mounted GDO keypad. In particular, it would be desirable to provide embodiments of a vehicular GDO control system that could be remotely controlled from the exterior of a closed garage door, and preferably, from virtually any distance utilizing a remote electronic device, such as a keyfob, smartphone, or other portable electronic device commonly carried on a user's person. It would also be desirable if, at least in some embodiments, such a vehicular GDO control system could provide feedback indicating the position of the garage door prior to and/or after remotely commanding the GDO unit to open or close the garage door. Lastly, it would also be desirable to provide methods and program products, such as a smartphone software application, for performance or usage in conjunction with such vehicular GDO control system. Other desirable features and characteristics of the present invention will become apparent from the subsequent Detailed Description and the appended Claims, taken in conjunction with the accompanying Drawings and the foregoing Background. No statement in the foregoing section shall be considered an admission of the teachings of prior art or of a technical problem or need recognized in the prior art.

BRIEF SUMMARY

Embodiments of a method performed in conjunction with a vehicular garage door control system are provided. The vehicular garage door control system may include an in-vehicle Garage Door Opener (GDO) signal generator, a wireless receiver, and a controller. In one embodiment, the method includes receiving, at the controller via the wireless receiver, a request signal originating from a remote electronic device requesting actuation of a GDO unit that, when actuated, moves a garage door between open and closed positions. In response to receipt of the request signal, a command signal is supplied from the controller to the in-vehicle GDO signal generator commanding the in-vehicle GDO signal generator to generate a GDO actuation signal requesting actuation of the GDO unit.

Further provided are embodiments of a vehicular garage door control system for deployment on a vehicle. In one embodiment, the vehicular garage door control system includes an in-vehicle Garage Door Opener (GDO) signal generator configured to generate a garage door actuation signal recognized by a GDO unit that, when actuated, moves a garage door between open and closed positions. A wireless receiver is configured to receive a wireless signal from a remote electronic device requesting actuation of the GDO unit. A controller is operatively coupled to the in-vehicle GDO signal generator and to the wireless receiver. The controller commands the in-vehicle GDO signal generator to generate a garage door actuation signal when the wireless receiver receives a wireless request signal from the remote electronic device requesting actuation of the GDO unit.

Still further provided are embodiments of a program product executable by a smartphone configured to communicate with a vehicular garage door control system over a wireless network. In one embodiment, the program product includes a smartphone software application comprising computer-readable instructions to: (i) generate on a display of the smartphone a virtual control enabling a user to request generation of a garage door actuation signal by the vehicular garage door control system; (ii) detect selection of the virtual control; and (iii) when the virtual control is selected, transmit a request signal over the wireless network to the vehicular garage door control system requesting generation of the garage door actuation signal. Non-transitory computer-readable media bears the smartphone software application.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
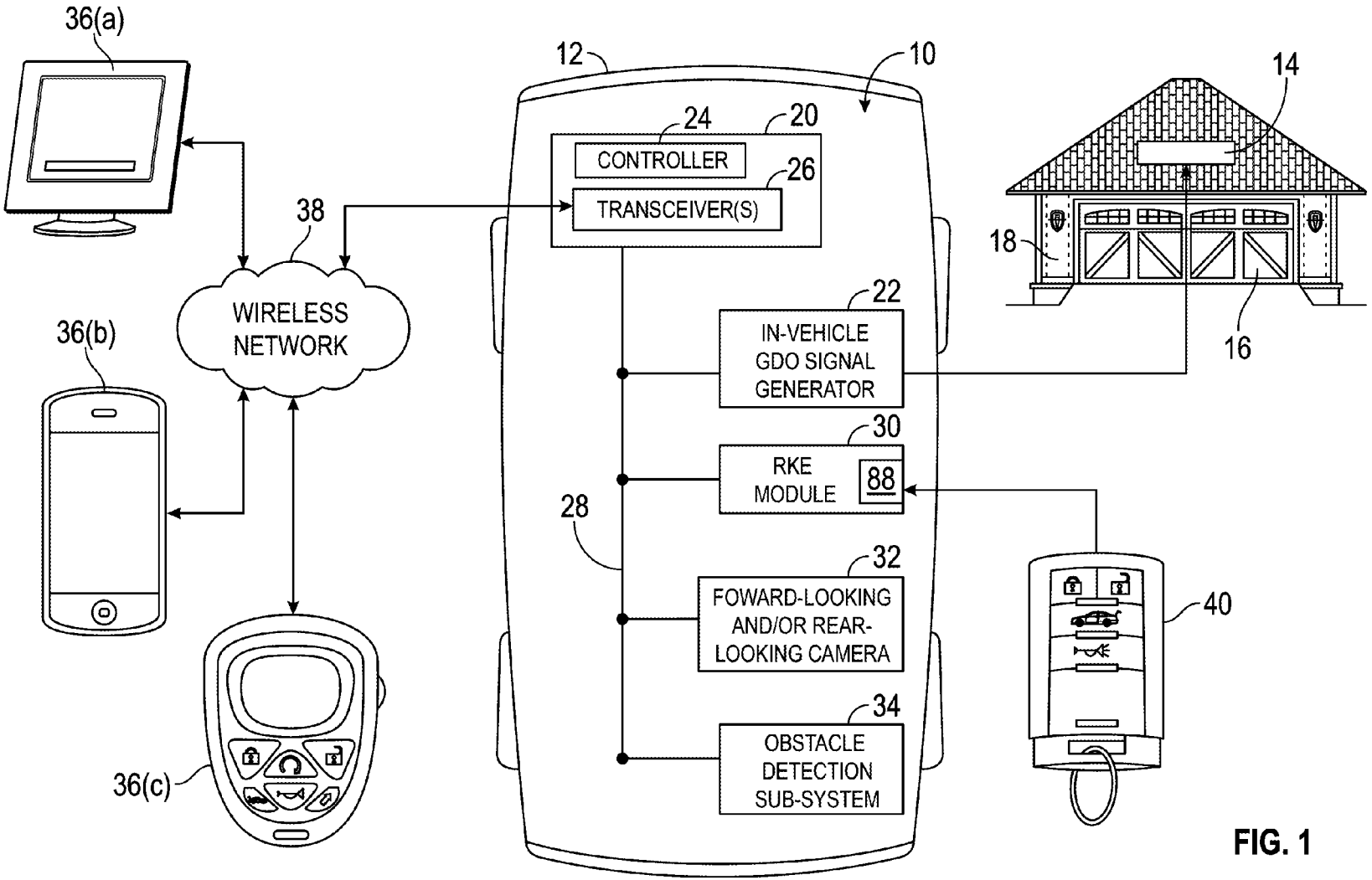
FIG. 1 is a schematic illustrating a vehicular Garage Door Opener (GDO) control system for controlling a GDO unit utilizing a remote electronic device other than a conventional GDO remote control, as illustrated in accordance with an exemplary and non-limiting embodiment of the present invention.

FIG. 1 is a schematic of a vehicular garage door opener (GDO) control system 10 deployed onboard a vehicle 12, as illustrated in accordance with an exemplary embodiment of the present invention. Vehicular GDO control system 10 enables a user to utilize one or more remote electronic devices other than a conventional GDO remote control to wirelessly control a GDO unit 14, which moves a garage door 16 between open and closed positions to selectively provide access to a garage 18. In so doing, GDO control system 10 enables a user to remotely open and close garage door 16, as desired, without possession of a dedicated GDO remote control. This can be desirable in instances wherein the remote electronic device assumes the form of a smartphone or keyfob, which the user would normally carry on his or her person, and the user departs his or her home to embark on a walk, run, bike ride, or similar venture. Additionally, in certain embodiments, GDO control system 10 enables a user to operate GDO unit 14 remotely over a wireless network, such a cellular or satellite network, utilizing one or more remote electronic devices, such as a smartphone or personal computer. In such cases, GDO control system 10 allows a user to utilize the remote electronic device to remotely open garage door 16 to, for example, grant a neighbor, delivery person, or other person assess to his or her garage when the user is at work, on vacation, or otherwise physically absent from the home. In still further embodiments, GDO control system 10 enables a user to remotely monitor the position of garage door 16 utilizing the remote electronic device to allow better oversight during remote control of GDO unit 14 and to ensure that garage door 16 is properly closed, when desired.

In the exemplary embodiment shown in FIG. 1, vehicular GDO control system 10 includes, amongst other components, a telematics module 20 and an in-vehicle GDO signal generator 22. Telematics module 20 contains a controller 24 and at least one transceiver 26, which is operatively coupled to controller 24 for bi-directional communication therewith. Controller 24, and more generally, telematics module 20 is further operatively coupled to GDO signal generator 22 via a vehicle data bus 28, which may be a Controller Area Network (CAN) bus. Controller 24 can be implemented utilizing any combination of hardware, software, firmware, and the like capable of executing the operations described herein. In this regard, controller 24 can include any suitable number of individual microprocessors, microcontrollers, digital signal processors, programmed arrays, memory elements, and other standard components known in the art. Additionally, controller 24 may include or cooperate with any number of software or firmware programs designed to carry out the various methods, process tasks, calculations, and control/display functions described herein. Controller 24 need not be integrated into telematics module 20 in all embodiments; rather, any suitable controller deployed onboard vehicle 12 can be utilized to perform the processes described herein below. It is preferred, however, that controller 24 assumes the form of the telematics controller in embodiments wherein vehicle 12 is equipped with a telematics module, such as telematics module 20 shown in FIG. 1, to leverage equipment preexisting on vehicle 12 and thereby allow implementation of vehicular GDO control system 10 with minimal cost and modification to the overall vehicle architecture. Indeed, in embodiments wherein vehicle 12 is pre-equipped with telematics module 20 and in-vehicle garage door control module 22, vehicular GDO control system 10 can be implemented largely through the programming of controller 24, along with provision of the necessary data connections between modules, sub-subsystems, and devices. In one embodiment, telematics module 20 is an OnStar® module commercially marketed and sold by the OnStar® corporation, which is a subsidiary of the assignee of the instant Application, the General Motors Company, currently headquartered in Detroit, Mich.

In-vehicle GDO signal generator 22 can be any device capable of generating a signal recognized and accepted by GDO unit 14 in commanding unit 14 to move garage door 16 between open and closed positions. In-vehicle GDO signal generator 22 will typically include or assume the form of a radiofrequency (RF) transmitter circuit that can be programmed for usage in conjunction with GDO unit 14 utilizing, for example, a dedicated GDO remote control. In accordance with current standards, GDO signal generator 22 may operate between 10 and 400 megahertz (MHz) frequencies, such as at 315 MHz, although GDO signal generator 22 is by no means limited to operation at this frequency or in this frequency range. Furthermore, certain garage door openers are currently known that operate on other shortwave radio frequencies (e.g., 2600-2680 MHz) utilizing, for example, Bluetooth® standards. GDO signal generator 22 will typically utilize well-known rolling code techniques wherein generator 22 produces a new code utilizing a seed number each time generator 22 generates an open/close garage door signal. GDO signal generator 22 may be included within a larger system or module, such as a Homelink® Wireless Control System, commercially marketed and sold by Johnson Controls, Inc., currently headquartered in Milwaukie, Wis.

During operation of vehicular GDO control system 10, transceiver 26 of telematics module 20 may communicate with one or more remote electronic devices 36 over a wireless network 38. Transceiver 26 can be any device or component capable of providing this functionality and may include, for example, a radiofrequency receiver or a satellite receiver. In embodiments wherein telematics module 20 is an OnStar® module, transceiver 26 may be capable of providing bi-directional Code Division Multiple Access (CDMA) mobile phone voice and data communication. Similarly, wireless network 38 can be any network permitting bi-directional data communication including, but not limited to, cellular networks, satellite networks, open content delivery networks, the Internet, or any other digital networks based upon TCP/IP or other conventional protocols, as well as combinations thereof. Wireless network 38 may also be a wide area network (WAN), a local area network (LAN), or a combination thereof conforming to, for example, IEEE 802.3 and/or IEEE 802.11 standards and implemented within the vicinity of the user's home such that telematics modules 20 may join the network when parked within garage 16 or in the general vicinity of the property on which garage 16 is located. Network 38 as illustrated in FIG. 1, then, is intended to broadly encompass any digital communications network(s), systems, or architectures for transmitting data between vehicular GDO control system 10 and one or more of electronic devices 36 of the type described below.

The remote electronic device 36 with which GDO control system 10 interfaces over wireless network 30 preferably assumes the form of a relatively small, user-portable electronic device, such as a smartphone 36(*b*) or an enhanced keyfob 36(*c*), which is capable of transmitting and receiving data over wireless network 38. However, the possibility that remote electronic device 36 should assume another form, such as that of a desktop or laptop computer 36(*a*), is by no means excluded. When assuming the form of a computer 36(*a*), smartphone 36(*b*), or similar device, the remote electronic device 36 may allow a user to interface with GDO control system 10 through the execution of a program application, as described below in conjunction with FIG. 3. Alternatively, a user may use the remote electronic device 36 to access a webpage over wireless network 38 allowing the user to remotely control GDO control system 10 in the below described manner. In this latter case, a user may be required to enter a password associated with a previously established user identification for security purposes.

Figure 2:
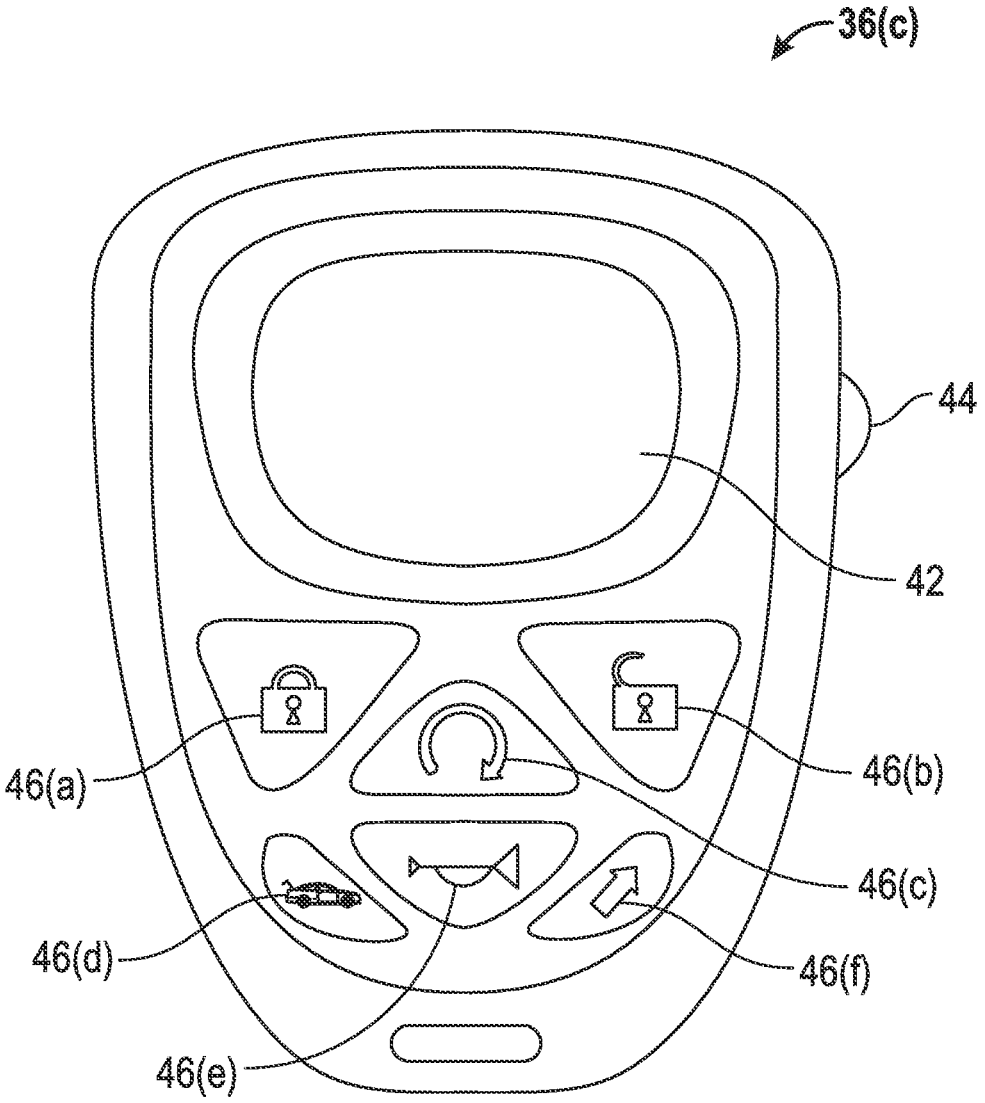
FIGS. 2 and 3 are isometric views of a keyfob and a smartphone, respectively, that can be utilized to interface with the vehicular GDO control system shown in FIG. 1 in accordance with further exemplary embodiments.

FIG. 2 provides a detailed isometric view of an exemplary enhanced keyfob 36(*c*), which may be utilized in conjunction with GDO control system 10 in an embodiment. In the illustrated example, enhanced keyfob 36(*c*) includes a display 42, a scroll wheel 44, and a number of buttons 46. Buttons 46 may include a lock button 46(*a*), an unlock button 46(*b*), a remote start button 46(*c*), a trunk unlock button 46(*d*), and a panic button 46(*e*). A sixth button 46(*f*) is also provided on keyfob 36(*c*) and may be assigned a dedicated garage door open/close functionality. In embodiments wherein button 46(*f*) is assigned such a dedicated garage open/close functionality, a user may need only depress button 46(*f*) to cause GDO control system 10, and specifically, in-vehicle door control module 22 to generate a garage door actuation (open/close) signal in the below-described manner. Alternatively, when a dedicated GDO button or other dedicated GDO user input is not provided on keyfob 36(*c*), a user may cause keyfob 36(*c*) to transmit a request to GDO control system 10 to generate a GDO actuation signal by navigation and selection of such an option from a Graphical User Interface (GUI) generated on display 42. For example, a user may utilize scroll wheel 44 to navigate through a text list of options and ultimately select (e.g., by depressing wheel 44 inwardly) a garage door open/close option. Upon selection of such an option, keyfob 36(*c*) may then transmit a request to GDO control system 10 over wireless network 38 to generate an actuate garage door signal utilizing in-vehicle GDO signal generator 22.

Figure 3:
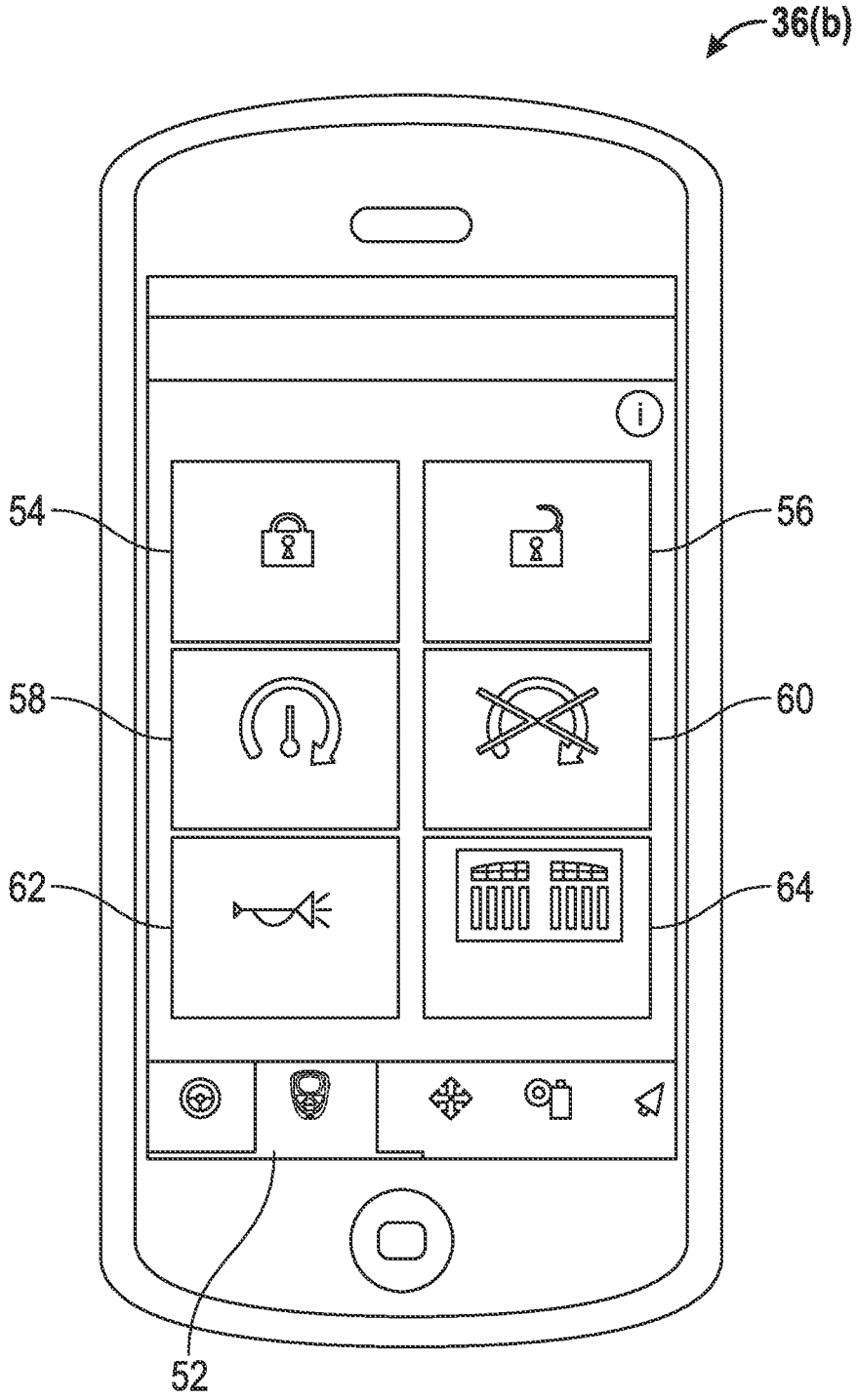

As previously indicated, the remote electronic device 36 with which GDO control system 10 interfaces over wireless network 30 may also assume the form of a smartphone 36(*b*). In this case, smartphone 36(*b*) may interface with GDO control system 10 utilizing a software application or applet residing in the memory of smartphone 36(*b*) and downloaded thereto over the Internet. For convenience of reference, a smartphone application allowing a user to interface with GDO control system 10 is referred to herein as a "GDO control system application," although it will be appreciated that the software application may also the user to perform additional actions relating to vehicle 12 other than remotely controlling system 10. Such other actions may be remotely starting the vehicle, remotely locking or unlocking the vehicle doors, remotely activating the vehicle lights and horn, remotely monitoring aspects of the vehicle (e.g., tire pressure, battery charge level, etc.), and so on. Further illustrating this point, FIG. 3 depicts an exemplary GUI 50 that may be generated on the display screen of smartphone 36(*b*) during execution of the GDO control system application. As can be seen, a user has selected a remote option page (indicated by highlighted virtual button 52) including a virtual lock button 54, a virtual unlock button 56, a virtual remote start button 58, a virtual cancel remote start button 60, a virtual panic button 62, and a virtual garage door open/close button 64. By selecting garage door open/close button 64 (e.g., by briefly touching the area of the screen corresponding to button 64 in embodiments wherein smartphone 36(*b*) is a touchscreen device), a user may cause smartphone 36(*b*) to transmit a request to GDO control system 10 to generate a GDO actuation signal, in the below described manner in conjunction with FIG. 4.

With continued reference to FIG. 1, GDO control system 10 may also include a Remote Keyless Entry (RKE) module 30 in certain embodiments. In such embodiments, GDO control system 10 can also be utilized in conjunction with a keyfob 40, such as a legacy keyfob, that is generally incapable of communicating over wireless network 38 and provides only short range radiofrequency communication abilities. Short range keyfob 40 may be provided with a dedicated button or other input for opening and closing garage door 16; and when actuated, may generate a unique signal requesting the generation of a GDO actuation signal by GDO control system 10. However, short range keyfob 40 need not include a dedicated GDO button; nor does keyfob 40 need generate a unique GDO signal. Instead, controller 24 may be programmed to recognize a request to generate an open/close garage door signal based upon the pattern or duration of another type of signal transmitted by keyfob 40. For example, a user may depress a preexisting button on keyfob 40 (e.g., the door unlock button) a predetermined number of times (e.g., 3 times) or for a predetermined duration (e.g., press and hold for 3 seconds) to transmit one or more signals that, when received by GDO control system 10, are recognized as a request to cause in-vehicle GDO signal generator 30 to generate the garage door/open close signal. By locating the intelligence wholly within controller 24 and/or in the other components of GDO control system 10 (e.g., the processor of RKE module 30) in this manner, GDO control system 10 can provide compatibility with legacy keyfobs without requiring modifications thereto.

With continued reference to FIG. 1, controller 24 may also be operatively coupled to one or more additional sub-systems, modules, or other devices deployed onboard vehicle 12 and included within GDO control system 10. For example, in certain embodiments, GDO control system 10 may also include one or more forward-looking and/or rear-looking cameras 32, which are operatively coupled to controller 24 of telematics module 20 via CAN bus 28. When rear-looking, camera or cameras 32 may be included within a back-up camera system. When forward-looking, the camera or cameras may be included within a lane monitoring system. In still further embodiments, GDO control system 10 may also include an obstacle detection sub-system 34, which is again operatively coupled to telematics module 20 via CAN bus 28. Obstacle detection sub-system 34 may be any system or device suitable for detecting the presence of obstacles, such as other vehicles, located forward or aft of vehicle 12. Common obstacle detection systems or devices suitable for usage as sub-system 34 include various different back-up obstacle detection systems, which monitor a detection field to the rear of a vehicle for by transmitting energy pulses (e.g. infrared, ultrasonic, or radar) and receiving pulses reflected back from any obstacles present within the detection field. Parallel park assist and adaptive cruse control systems also employ radar or other wireless detection sensors capable of detecting the presence of obstacles forward and/or aft of vehicle 12 and are consequently also well-suited for usage as obstacle detection sub-system 34. Again, by utilizing preexisting equipment already deployed on vehicle 12, which is normally inactive when vehicle 12 is non-operational and therefore can be freely recruited to perform the below-described functions, GDO control system 10 can be implemented with minimal cost and modification to the vehicle.

In certain embodiments, obstacle detection sub-system 34 may include one or more vehicle-mounted cameras (e.g., a forward- and/or rear-looking stereoscopic camera assembly) in addition to or in lieu of other non-visual sensors (e.g., infrared, ultrasonic, or radar of the type described above), along with suitable processing means for performing image recognition algorithms capable of detecting the presence of obstacles within the vicinity of vehicle 12 based upon the images captured by the vehicle-mounted camera or cameras. In such embodiments, the camera or cameras generically represented by block 32 in FIG. 1 may effectively be integrated into obstacle detection sub-system 34. In further embodiments, GDO control system 10 may include only one or more forward-looking and/or rear-looking camera 32 and may not include obstacle detection sub-system 34. Conversely, embodiments of GDO control system 10 may include only obstacle detection-subsystem 34 and lack forward and/or rearward-looking cameras 32. In still further implementations, GDO control system 10 may not include either forward and/or rearward-looking camera 32 or obstacle detection sub-system 34.

Figure 4:
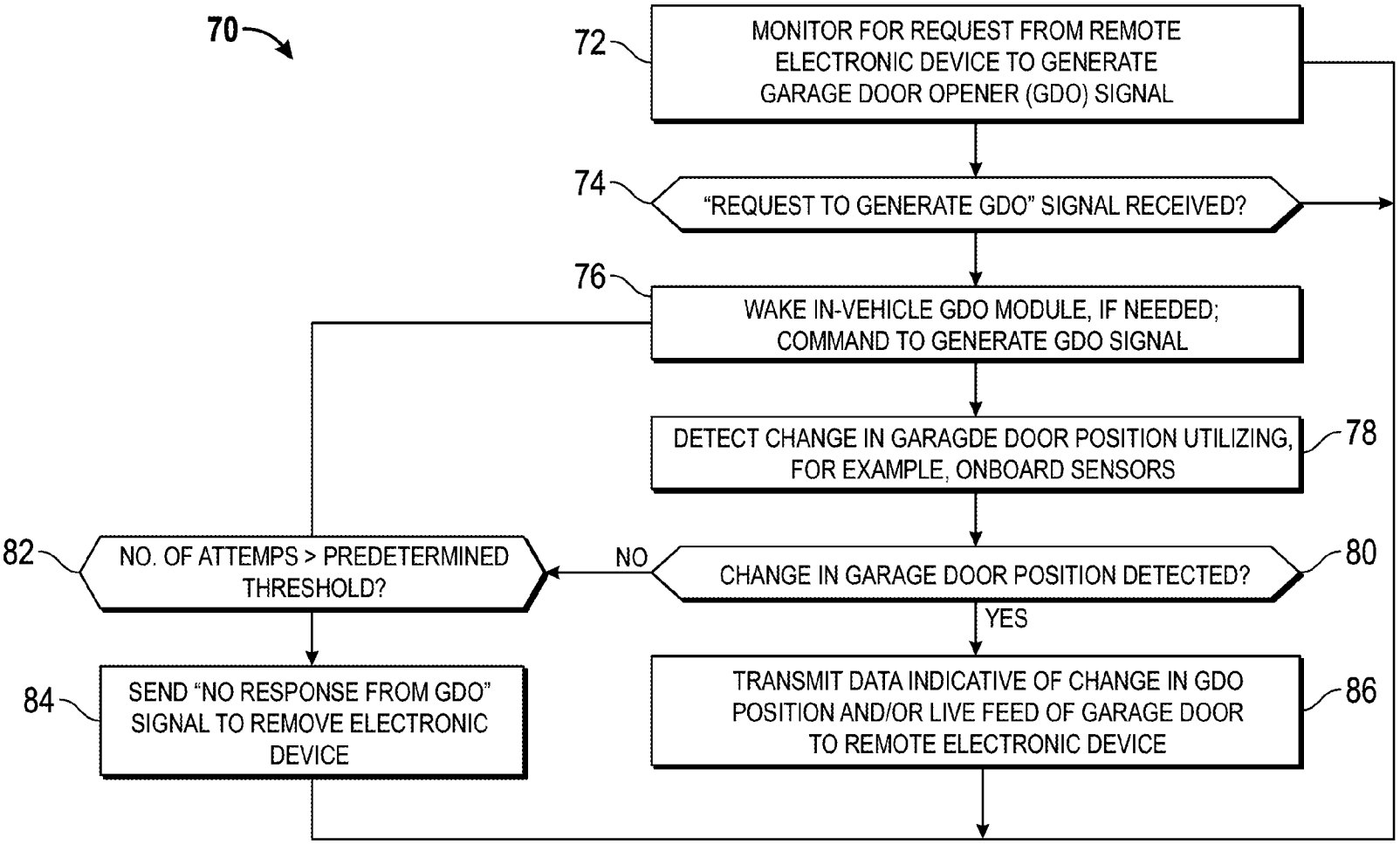
FIG. 4 is a flowchart illustrating an exemplary method that may be carried-out by the vehicular GDO control system shown in FIG. 1 to enable the remote control and monitoring of a garage door nearby the vehicle utilizing a remote electronic device, such as any one of the remote electronic devices shown in FIGS. 1-3.

FIG. 4 is a flowchart illustrating a method 70 that can be carried-out by controller 24 (FIG. 1) in accordance with an exemplary and non-limiting embodiment of the present invention. Method 70 can be performed continually or, instead, only at selected intervals, such as when the engine or motor of vehicle 12 is shutdown. To commence method 70 (STEP 72), controller 24 monitors for a signal from remote electronic device 30 and/or from short range keyfob 40 indicative of a request to generate a GDO actuation signal. In the case of remote electronic device 30, controller 24 monitors for receipt of such a request signal over wireless network 38 utilizing transceiver 26 (FIG. 1). In the case of short range RF keyfob 40, controller 24 monitors for receipt of the signal generation request utilizing the wireless (e.g., RF) receiver of RKE module 30. As indicated in FIG. 4 at STEP 74, controller 24 continually monitors for a GDO signal generation request until such a request is received, in which case controller 24 supplies a signal to in-vehicle garage door control module 22 (FIG. 1) commanding module 22 to generate a GDO actuation signal in accordance with the newly-received request (STEP 76). To conserve energy, in-vehicle garage door control module 22 may be placed in a quiescent or powered-down state when the engine of vehicle 12 is shutdown. Consequently, controller 24 may be required to wake in-vehicle garage door control module 22 from such a quiescent state prior to commanding the signal generating circuit of module 22 to produce the GDO actuation signal.

In basic embodiments of method 70, controller 24 may return to STEP 72 after generation of the GDO actuation signal (STEP 76) and continue monitoring for additional GDO signal generation requests. In such cases, GDO control system 10 (FIG. 1) need only be equipped with a controller, an in-vehicle GDO signal generator, and a receiver suitable for receiving GDO signal generation requests from the remote electronic device. However, in instances wherein GDO control system 10 (FIG. 1) is equipped with a device, sub-system, or module capable of detecting the position of garage door 16 (providing that vehicle 12 is parked inside garage 18 or parked immediately outside of garage door 16 and positioned facing toward or facing away therefrom), controller 24 may utilizing such a device, sub-system, or module to determine if a change in garage door position is detected (STEP 78). For example, if obstacle detection sub-system 34 no longer detects the presence of an obstacle to the vehicle's rear, as previously detected, controller 24 may conclude that garage door 16 has opened in response to receipt of the recently-generated actuation signal by GDO unit 14. Conversely, if obstacle detection sub-system 34 now detects the presence of an obstacle to the vehicle's rear, which was previously not detected, controller 24 may conclude that garage door 16 has closed. In other embodiments, controller 24 may be configured to analyze images received from camera 32 to determine whether a change in garage door position has occurred subsequent to generation of the GDO actuation signal during STEP 78 of exemplary method 70.

If a change in garage door position is not detected by GDO control system 10 during STEP 80, controller 24 may determine whether the number of attempts in opening or closing garage door 16 exceeds a predetermined threshold value, such as three attempts (STEP 82). If the predetermined threshold has not been exceeded, controller 24 may return to STEP 76 and again command in-vehicle garage door control module 22 to generate a GDO actuation signal. If, however, the predetermined number of attempts has been exceeded, controller 24 may transmit a "NO RESPONSE FROM GDO" error signal to remote electronic device 36 over wireless network 38. Remote electronic device 36 may then provide a text message or other visual indication on its display relating that GDO control system 10 has been unsuccessful in commanding GDO unit 14 to open or close garage door 16 (STEP 84). GDO control system 10 may not provide such an error signal in the case of short range keyfob 40 as keyfob 40 may be incapable of visually or otherwise relating this information to the user. Such feedback will typically be unneeded, however, as the user will often be within visual range of garage door 16 when using keyfob 40 to activate GDO control system 10. After generation of the error signal (STEP 84), controller 24 may return to STEP 72 and repeat method 70.

If, during STEP 80 of method 70 (FIG. 1), a change in the position of garage door 16 is detected, controller 24 may advance to STEP 86 during which GDO control system 10 transmit data to remote electronic device 36 indicative of the change in garage door position. Such data may simply be a signal indicating that the position of the garage door has changed, in which case remote electronic device 36 may provide a visual indication on its screen that the GDO actuation signal was received and acted upon by GDO unit 14; e.g., a green checkmark or similar icon may be temporarily produced near virtual button 64 shown in FIG. 3. Such data may also indicate the updated position of garage door 16, in which case remote electronic device 36 may provide a visual indication of the current position of garage door 16 on its screen; e.g., the appearance of virtual button 64 may be modified to visually indicate that the garage door is currently in an open or closed position. In still further embodiments wherein GDO control system 10 includes a camera 32, GDO control system 10 may transmit an image or picture of the area immediately in front and/or behind the vehicle to remote electronic device 36 for presentation on the display thereof. By viewing this picture, the user may then be able to determine the current position of garage door 16 and whether a change in garage door position has occurred. Similarly, in embodiments wherein GDO control system 10 includes camera 32, GDO control system 10 may transmit a streaming video feed of the area in front of and/or behind vehicle 12 in addition to or in lieu of the transmission of a verification signal. Afterwards, controller 24 returns to STEP 72 and exemplary method 70 is repeated.

In still further embodiments, GDO control system 10 may provide a streaming video feed or another indication of the current position of garage door 16 prior to receiving a request from remote electronic device 36 to generate an open/close garage door signal. For example, in such embodiments, the software application executed by remote electronic device 36 may provide the user with an option to view the current status of garage door 16, and in response to selection thereof, may transmit a request to GDO control system 10 to provide a signal indication of the current garage door position or a picture or live streaming feed of an area adjacent vehicle 12 in which the garage door may be located; e.g., a picture or live feed of the area immediately behind the vehicle in instances wherein vehicle 12 is parked within garage 18, or a picture or live feed of the area to the front of vehicle 12 in instances wherein vehicle 12 is parked outside of garage 18, while facing toward garage door 16. Alternatively, the software application executed by remote electronic device 36 may automatically send a request to GDO control system 10 to provide such data upon execution of the software application or navigation to the page or menu containing the widget (e.g., virtual button 64 shown in FIG. 3) utilized to command GDO control system 10 to generate the GDO actuation signal.

The foregoing has thus provided embodiments of a vehicular GDO control system that can be remotely controlled from the exterior of a closed garage door utilizing a remote electronic device other than a dedicated GDO remote control. In preferred embodiments, the remote electronic device is a smartphone or keyfob of the type commonly carried on a user's person. In such embodiments, the vehicular GDO remote control system increases user convenience when it is more convenient for the user to carry a smartphone or keyfob than the GDO remote control, as may be the case when a user embarks his or her home for the purposes of walking, biking, running, or the like. In preferred embodiments, the GDO control system further enables a user to operate a GDO unit or mechanism remotely over a wireless network, such a cellular or satellite network, utilizing the remote electronic device. In this way, a user can utilize the remote electronic device to remotely open a garage door to, for example, grant a neighbor, delivery person, or other person assess to his or her garage when the user is at work, on vacation, or otherwise physically absent. Embodiments of the above-described GDO control system also enables a user to remotely monitor the position of a garage door utilizing the remote electronic device. Embodiments of the above-described GDO control system may also be compatible with conventional short range keyfobs without need for modification or specialized functionality of the keyfob. Notable, in embodiments wherein GDO control system is integrated into a vehicle already equipped with an OnStar® system or other telematics module and/or a HomeLink® system or other system including a GDO signal generating circuit, the GDO control system can be implemented largely through programming, and therefore, with minimal cost and with little additional hardware.

In one embodiment, the vehicular garage door control system includes an in-vehicle GDO signal generator, which is configured to generate a GDO actuation signal; and a wireless receiver, which is configured to receive a wireless signal from a remote electronic device relating a request to actuate the garage door. The wireless receiver in this case may be either the receiver included within transceiver 26 of telematics module 20 shown in FIG. 1, in which case the wireless signal may be received over wireless network 38 (FIG. 1); or an RF or other receiver included within RKE module 30 (generically represented in FIG. 1 by reference numeral "88"), in which case the wireless signal may be received directly from the remote electronic device in the form of a short range keyfob. A controller, which is coupled to the in-vehicle GDO signal generator and to the wireless receiver, commands the in-vehicle GDO signal generator to generate a GDO actuation signal when the wireless receiver receives the request signal from the remote electronic device.

While the foregoing exemplary embodiment was described above in the context of interactions between a fully functioning vehicle system (i.e., vehicular GDO control system 10 shown in FIG. 1) and a remote electronic device (e.g., one or all of remote electronic devices 36 shown in FIGS. 1-3), those skilled in the art will recognize that the mechanisms of the present invention are capable of being distributed as a non-transitory program product (e.g., a smartphone software application), and furthermore, that the teachings of the present invention apply to the program product regardless of the particular type of computer-readable media (e.g., floppy disc, hard drive, memory card, optical disc, etc.) employed to carry-out its distribution. For example, embodiments of a process have also been described herein that can be implemented as a software application or applet executable by smartphone 36(*b*). In this case, the smartphone software application may include computer-readable instructions to: (i) generate on a display of the smartphone a virtual control or widget (e.g., virtual button 64 shown in FIG. 3) enabling a user to request generation of a garage door actuation signal by the vehicular garage door control system; detect selection of the virtual control (e.g., utilizing a touch screen or cursor-based user interface); and (iii) when the virtual control is selected, transmit a request signal over the wireless network to the vehicular garage door control system requesting generation of the garage door actuation signal.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A method performed in conjunction with a vehicular garage door control system including an in-vehicle Garage Door Opener (GDO) signal generator, a camera, a wireless receiver, and a controller operatively coupled to the in-vehicle GDO signal generator, to the camera, and to the wireless receiver, the method comprising:

receiving, at the controller via the wireless receiver, a request signal originating from a remote electronic device requesting actuation of a GDO unit that, when actuated, moves a garage door between open and closed positions;

in response to receipt of the request signal, supplying a command signal from the controller to the in-vehicle GDO signal generator commanding the in-vehicle GDO signal generator to generate a GDO actuation signal requesting actuation of the GDO unit;

after generation of the GDO actuation signal by the in-vehicle GDO signal generator, receiving, at the controller, a picture or streaming video feed of an area in front of or behind the vehicle, as captured by the camera; and transmitting the picture or streaming video feed from the controller to the remote electronic device for presentation on a display thereof.

2. The method of claim 1 wherein the request signal is transmitted from the remote electronic device to the wireless receiver over a wireless network.

3. The method of claim 2 wherein the remote electronic device comprises a smartphone, and wherein the request signal is transmitted from the smartphone to the wireless receiver over a cellular network when the smartphone is executing a software application and user input is received requesting actuation of the GDO unit.

4. The method of claim 2 further comprising:

determining, in the controller, if a change in garage door position has occurred; and transmitting data from the controller, over the wireless network, to the remote electronic device data indicative of the change in garage door position.

5. The method of claim 4 further comprising supplying a command signal from the controller to the in-vehicle GDO signal generator commanding the in-vehicle GDO signal generator to generate a second GDO actuation signal if a garage door position change is not detected after generation of a first GDO actuation signal.

6. The method of claim 4 wherein the vehicular garage door control system comprises an obstacle detection sub-system deployed onboard the vehicle and operatively coupled to the controller, and wherein the method further comprises determining, in the controller, the position of the garage door utilizing the obstacle detection sub-system.

7. The method of claim 4 wherein the data transmitted from the controller, over the wireless network, to the remote electronic device data is indicative of the current detected position of the garage door.

8. The method of claim 4 wherein the data transmitted from the controller, over the wireless network, to the remote electronic device data indicates that a change in the position of the garage door has occurred after generation of the GDO actuation signal.

9. The method of claim 1 further comprising a telematics module deployed onboard the vehicle and including the receiver and the controller.

10. The method of claim 1 wherein the vehicular garage door control system further comprises a Remote Keyless Entry (RKE) module operatively coupled to the controller, wherein the receiver is included within the RKE module, and wherein receiving comprises receiving via the RKE module a request signal requesting actuation of the GDO unit from a keyfob.

11. The method of claim 10 further comprising identifying in the controller the request signal based at least partially upon the pattern of signals received from the keyfob, the duration of signals received from the keyfob, or a combination thereof.

12. A vehicular garage door control system for use in conjunction with a keyfob and a garage door opener (GDO) unit utilized to move a garage door between open and closed positions, the vehicular garage door control system comprising:

an in-vehicle GDO signal generator configured to generate a garage door actuation signal recognized by the GDO unit;

a Remote Keyless Entry (RKE) module including a wireless receiver configured to receive a wireless signal from keyfob requesting actuation of the GDO unit; and a controller operatively coupled to the in-vehicle GDO signal generator and to the wireless receiver of the RKE module, the controller commanding the in-vehicle GDO signal generator to generate a garage door actuation signal when the wireless receiver receives a wireless request signal from the keyfob requesting actuation of the GDO unit;

wherein the controller identifies the wireless signal originating from the keyfob requesting actuation of the GDO unit based upon the pattern or duration of a signal transmitted from the keyfob when an input dedicated to a different type of function is actuated by a user of the keyfob.

13. A program product executable by a smartphone configured to communicate with a vehicular garage door control system over a wireless network, the program product comprising:

a smartphone software application comprising computer-readable instructions to:

generate on a display of the smartphone a virtual control enabling a user to request generation of a garage door opener (GDO) actuation signal by the vehicular garage door control system to open or close a garage door;

determine when the virtual control has been selected;

when the virtual control has been selected, transmit a request signal over the wireless network to the vehicular garage door control system requesting generation of the GDO actuation signal;

receive from the vehicular garage door control system a picture or streaming video feed of an area in front of or behind the vehicle, as captured by a camera included in the vehicular garage door control system; and display the picture or streaming video feed on the display of the smartphone to enable the user to determine the position of the garage door; and non-transitory computer-readable media bearing the smartphone software application.

14. The program product of claim 13 wherein the smartphone software application further comprises instructions to produce on the display of the smartphone a visual indication of the current position of the garage door, as detected by the vehicular garage door control system.

15. The method of claim 4 further comprising:

repeatedly generating the GDO actuation signal until a garage door position change is detected or until a predetermined number of actuation attempts is exceeded; and if the predetermined number of actuation attempts has been exceeded, transmitting an error signal to the remote electronic device over the wireless network.

16. The program product of claim 13 wherein the smartphone software application further comprises instructions to automatically send a request to the vehicular garage door control system for a picture or streaming video feed of an area in front of or behind the vehicle upon initial execution of the software application.

* * * * *